US012168912B1

(12) United States Patent
Guan et al.

(10) Patent No.: US 12,168,912 B1
(45) Date of Patent: Dec. 17, 2024

(54) DOWNHOLE HYDRAULIC DIRECTIONAL CONTROL VALVE USED BY HYDRAULIC POWER PUMPS AND WORKING METHOD THEREOF

(71) Applicant: SHANDONG WEIMA PUMPS MANUFACTURING CO., LTD, Shandong (CN)

(72) Inventors: Bing Guan, Jinan (CN); Baozhong Ma, Jinan (CN); Sifeng Bi, Jinan (CN); Meng Liu, Jinan (CN); Xuejiang Li, Jinan (CN); Chao Gao, Jinan (CN); Xingbao Teng, Jinan (CN)

(73) Assignee: SHANDONG WEIMA PUMPS MANUFACTURING CO., LTD, Shandong (CN)

( * ) Notice: Subject to any disclaimer, the term of this patent is extended or adjusted under 35 U.S.C. 154(b) by 0 days.

(21) Appl. No.: 18/716,191

(22) PCT Filed: Nov. 29, 2023

(86) PCT No.: PCT/CN2023/135085

§ 371 (c)(1),
(2) Date: Jun. 4, 2024

(87) PCT Pub. No.: WO2024/114684

PCT Pub. Date: Jun. 6, 2024

(30) Foreign Application Priority Data

Nov. 30, 2022 (CN) ..... 202211519304.X

(51) Int. Cl.

| | |
|---|---|
| ***E21B 43/12*** | (2006.01) |
| ***E21B 34/10*** | (2006.01) |
| ***F04B 47/04*** | (2006.01) |

(52) U.S. Cl.
CPC ..... *E21B 34/10* (2013.01); *F04B 47/04* (2013.01)

(58) Field of Classification Search
CPC ..... E21B 34/10; E21B 43/129
See application file for complete search history.

(56) References Cited

U.S. PATENT DOCUMENTS

2021/0148179 A1 5/2021 Petrella et al.

FOREIGN PATENT DOCUMENTS

| | | | |
|---|---|---|---|
| CN | 2711386 | Y | 7/2005 |
| CN | 101216028 | A | 7/2008 |
| CN | 103423135 | A | 12/2013 |

(Continued)

*Primary Examiner* — Giovanna Wright
*Assistant Examiner* — Ronald R Runyan
(74) *Attorney, Agent, or Firm* — IPRO, PLLC; Na Xu

(57) ABSTRACT

The present invention provides a downhole hydraulic directional control valve, comprising a valve body assembly having a shell, an outer tube being provided in the shell, a middle joint connecting the outer tube and an upper cylinder, an outer cylinder connected to the upper cylinder, and a double-way joint being provided with an oil inlet hole, and connecting top ends of the outer cylinder and an inner cylinder; a valve core assembly having an upper valve core, and a lower valve core being positioned at bottom end of the upper valve core and further positioned in a lower cylinder at bottom end of the middle joint; and, a plunger assembly having a first plunger part positioned in the inner cylinder and a second plunger part at bottom end of the first plunger part. By using this valve, the operation efficiency is improved, and the reliability of the equipment is ensured.

8 Claims, 9 Drawing Sheets

(56) References Cited

FOREIGN PATENT DOCUMENTS

| | | | |
|---|---|---|---|
| CN | 107100592 | A | 8/2017 |
| CN | 109653710 | A | 4/2019 |
| CN | 111088966 | A | 5/2020 |
| CN | 211692416 | U | 10/2020 |
| CN | 113653468 | A | 11/2021 |
| CN | 115788360 | A | 3/2023 |

DOWNHOLE HYDRAULIC DIRECTIONAL CONTROL VALVE USED BY HYDRAULIC POWER PUMPS AND WORKING METHOD THEREOF

The present invention claims priority benefits to Chinese patent application filed with the China National Intellectual Property Administration on Nov. 30, 2022, Application No. 202211519304.X, entitled "a downhole hydraulic directional control valve used by hydraulic power pumps and working method thereof", the entire contents of which are incorporated herein by reference.

TECHNICAL FIELD

The invention relates to the technical field of oil and gas lifting equipment in oilfield, in particular to a downhole hydraulic directional control valve used by a hydraulic power pump and a working method thereof.

BACKGROUND

The statements in this section merely provide background technical information related to the present invention and do not necessarily constitute prior technology.

At present, a directional change mode of a hydraulic power pump used for the oil and gas lifting in the oilfield adopts directional change through a ground directional control valve. For example, a Chinese granted patent CN211692416U discloses a hydraulic rodless drainage and gas recovery device and a two-position four-way directional control valve, wherein a power liquid enters through pressure control and repeatedly switches through two different flow passages to drive a downhole plunger pump to reciprocate up and down, so as to achieve the purpose of oil and gas lifting. This kind of the directional change mode requires two valve chambers of the directional control valve to repeatedly relieve pressure and boost pressure to ensure that the power fluid is repeatedly switched in the two different flow passages, resulting in long directional change time, large pressure loss, low efficiency, and reduced reliability for long-term operation.

SUMMARY

For overcoming the defects of the prior art, the present invention provides a downhole hydraulic directional control valve used by hydraulic power pumps, which does not need ground equipment to repeatedly relieve pressure and boost pressure, has short directional change time, small pressure loss and high reliability.

To achieve the above objectives, the present invention adopts the following technical solution:

In a first aspect, one or more embodiments of the present invention provide a downhole hydraulic directional control valve used by hydraulic power pumps, comprising:

a valve body assembly, comprising a shell, an outer tube is provided in the shell, the outer tube and the shell form a space defined as a first passage, the outer tube is sleeved at a top end of a middle joint, the middle joint is sleeved at a bottom end of an upper cylinder, a top end of the upper cylinder is connected with an outer cylinder, the outer cylinder, the upper cylinder and the outer tube form a space defined as a second passage, an inner cylinder is provided in the outer cylinder and forms, with the outer cylinder, a space defined as a third passage, top ends of the outer cylinder and the inner cylinder are connected with a double-way joint, a central hole of the double-way joint is communicated with the second passage and is further provided with an oil inlet hole communicated with the third passage, an inner space of the upper cylinder is communicated with the second passage, and an inner space of the middle joint is communicated with the first passage;

a valve core assembly, comprising an upper valve core and a lower valve core positioned at a bottom end of the upper valve core, wherein the upper valve core is positioned in the upper cylinder and forms, with the upper cylinder, a space defined as a fourth passage, and the lower valve core is positioned in a lower cylinder positioned at a bottom end of the middle joint; and a plunger assembly, passing through the valve core assembly and comprising a first plunger part positioned in the inner cylinder and a second plunger part at a bottom end thereof, a top end of an inner space of the second plunger part is communicated with the third passage, and a liquid inlet hole, matched with an inner valve chamber of the lower cylinder, is further provide on the second plunger part.

Optionally, a top end of the outer tube is connected with a central pipe joint.

Optionally, the double-way joint is provided with a first liquid inlet hole communicating a central hole of the double-way joint with the second passage.

Optionally, the middle joint is provided with a second liquid inlet hole communicating an inner space of the middle joint with the first passage.

Optionally, a top end of the shell is connected with an oil pipe upper joint, and a bottom end of the shell is connected with a lower pump cylinder joint.

Optionally, a bottom end of the lower cylinder is connected with a bottom cylinder through a lower joint, the bottom cylinder is positioned on a periphery of the second plunger part, a lower joint outer tube is provided on a periphery of the bottom cylinder, and the lower joint outer tube is connected to the lower joint through an oil pipe coupling.

Optionally, a top end of the upper valve core is provided with an upper annular boss, the upper annular boss is in clearance fit with an inner surface of the upper cylinder, a bottom end of the upper valve core is provided with a lower annular boss, a top end of the lower valve core is sleeved and fixed on a periphery of the lower annular boss and is in fit with the lower cylinder, and a fourth passage is formed between the upper annular boss and the lower annular boss.

Optionally, a difference in cross-sectional areas between the first plunger part and the second plunger part is smaller than a cross-sectional area of the first plunger part.

Optionally, the second plunger part comprises a first section, a second section and a third section provided in sequence, wherein the first section is connected with the first plunger part through a first joint, a third liquid inlet hole communicated with the first section is provided on the first joint, the first section further is communicated with the second section through a second joint, a fourth liquid inlet hole communicated with the first section is provided on the second section, the second section is connected with the third section through a third joint, and a fifth liquid inlet hole communicated with the third section is provided on the third joint.

In a second aspect, one or more embodiments of the present invention provide a working method of the downhole hydraulic directional control valve used by hydraulic power pumps according to the first aspect, comprising:

an up-stroke: when the plunger assembly moves to a lower dead center, a power fluid is introduced into the inner valve chamber of the lower cylinder through the oil inlet hole, the third passage, the inner space of the second plunger part and the liquid inlet hole thereof, the valve core assembly is moved upward under an action of the power fluid until the fourth passage is communicated with the second passage, a plunger of an oil-well pump is drove, by the plunger assembly, to move upward under a working condition that a pressure of the power fluid continues to rise, and the produced fluid is discharged to the ground through the first passage, and a spent power fluid in a space above the plunger assembly is discharged, through the guide of the center hole of the double-way joint, the second passage, the fourth passage, and the middle joint, to the ground through the first passage; and a down-stroke: when the plunger assembly moves to a upper dead center, the power fluid is guided, through the double-way joint, into the first passage, the valve core assembly is descended to the third passage under the action of the power fluid to be communicated with the second passage through the upper cylinder, the power fluid is guided, by the third passage and the second passage, into the valve chamber above the plunger assembly through the center hole of the double-way joint to drive the plunger assembly to descend, which can drive the plunger of the oil-well pump to move downward, and the produced fluid is discharged to the ground through the first passage.

The beneficial effects of the present invention are as follows.

According to the present invention, the downhole hydraulic directional control valve, through the arrangement of the valve core assembly, the plunger assembly and a plurality of passages, can realize the directional change by driving the plunger assembly to ascend through the ascending of the valve core assembly and the action of power fluid when the plunger assembly is positioned at the lower dead center; and further can realize the directional change by driving the plunger assembly to descend through the power fluid entering the valve chamber above the plunger assembly, by driving, by the power fluid, the valve core assembly to descend, when the plunger assembly is positioned at the upper dead center. Throughout the entire process, only the power fluid needs to be continuously introduced into the double-way joint; the pressure equipment on the ground does not need to achieve directional change through repeated pressure relief and boosting. The directional change process is automatically completed through the downhole hydraulic directional control valve, and the produced liquid and the spent power fluid are always discharged through the first passage, thus the directional change time is significantly shortened, the pressure loss is greatly reduced, and the efficiency is significantly improved, and ensuring the reliability of the equipment.

BRIEF DESCRIPTION OF THE DRAWINGS

The accompanying drawings constituting a part of the present invention are used to provide a further understanding of the present invention. The exemplary examples of the present invention and descriptions thereof are used to explain the present invention, and do not constitute an improper limitation of the present invention.

Wherein, 1—center pipe joint, 2—upper oil pipe joint, 3—double-way joint, 31—oil inlet hole, 32—first liquid inlet hole, 4—inner cylinder joint, 5—shell, 6—outer tube, 7—outer cylinder, 8—inner cylinder, 9—outer cylinder joint, 10—upper cylinder, 101—sixth liquid inlet hole, 11—middle joint, 111—second liquid inlet hole, 12—lower cylinder, 13—lower joint, 14—oil pipe coupling, 15 bottom cylinder, 16—lower joint outer tube, 17—lower pump cylinder joint, 18—upper plug, 19—first plunger part, 20—first joint, 201—third inlet hole, 21—first section, 22—second joint, 221—fourth inlet hole, 23—second section, 24—third joint, 241—fifth inlet hole, 25—third section, 26—fourth joint, 261—seventh inlet hole, 27—upper valve core, 28—lower valve core.

DETAILED DESCRIPTION

Example 1

The present embodiment provides a downhole hydraulic directional control valve used by hydraulic drive pumps, as shown in FIGS. 1-5, comprising a valve body assembly, a valve core assembly and a plunger assembly, wherein the valve core assembly is positioned inside the valve body assembly and is in clearance fit with the valve body assembly, and the plunger assembly passes through the valve core assembly and is in clearance fit with the valve core assembly.

Figure 6:
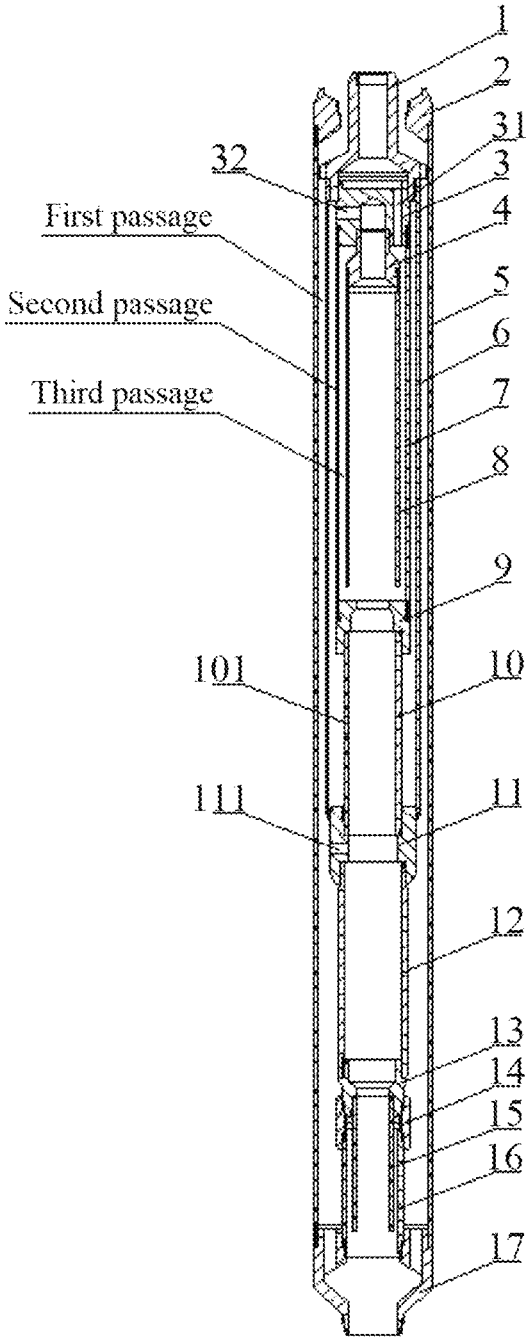
FIG. 6 is a schematic structural diagram of a valve body assembly in the Embodiment 1 of the present invention.
Figure 7:
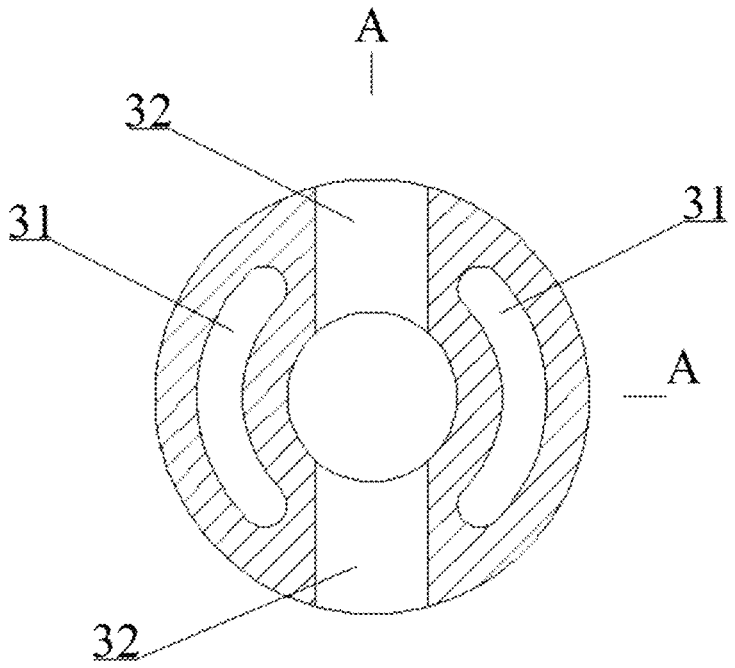
FIG. 7 is a sectional top view of a double-way joint in the Embodiment 1 of the present invention.
Figure 8:
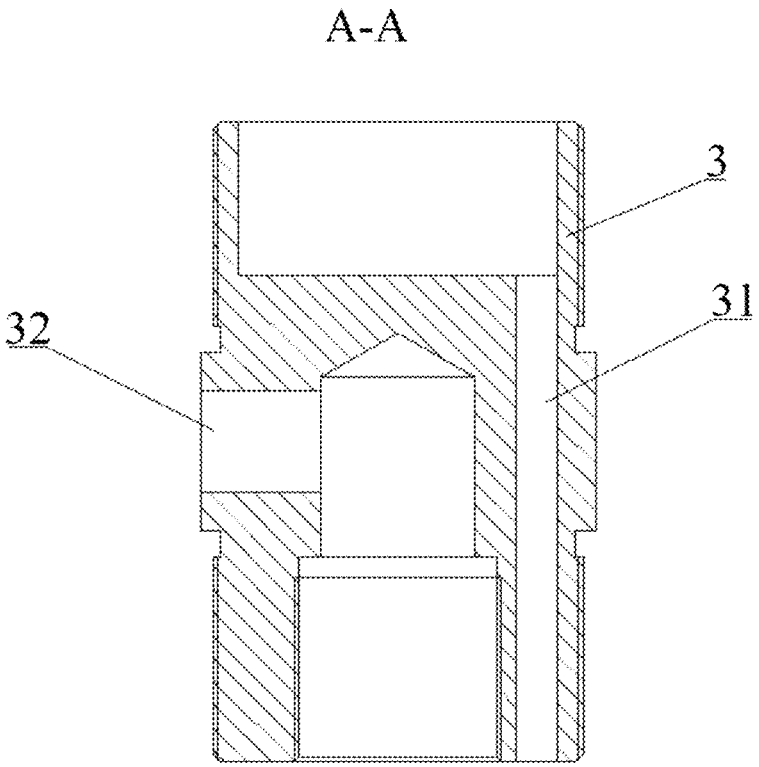
FIG. 8 is a schematic view at an A direction in FIG. 7 of the present invention.

As shown in FIGS. 6-8, the valve body assembly comprises a cylindrical shell 5, a top end of the shell 5 is threadedly connected with an upper oil pipe joint 2, the upper oil pipe joint 2 is used for connecting an oil pipe, and a bottom end of the shell 5 is threadedly connected with a lower pump cylinder joint 17, which is used for connecting a pump cylinder of an oil-well pump.

A center pipe joint 1 is provided at a top position of a space inside the shell 5 and is used for connecting a center pipe, and a passage is provided inside the center pipe joint 1.

A bottom end of the center pipe joint 1 is in threaded connection with a top end of a double-way joint 3 through an internal thread structure, and the bottom end of the center pipe joint 1 is in threaded connection with a top end of an outer pipe 6 through an external thread structure. The outer pipe 6 is provided inside the shell 5 and coaxially arranged with the shell 5.

A center hole is formed in a center position of a bottom surface of the double-way joint 3, and the center hole is a counterbore. The double-way joint 3 is radially provided with two first liquid inlet holes 32, and the two first liquid inlet holes 32 communicate with the center hole and are symmetrically arranged relative to the center hole.

The double-way joint 3 is further provided with two oil inlet holes 31, the two oil inlet holes 31 penetrate through two end surfaces of the double-way joint perpendicular to an axis thereof, and top ends of the oil inlet holes are communicated with the passage in the central pipe joint 1.

A bottom end of the center hole of the double-way joint 3 is connected with a top end of an inner cylinder joint 4, and a bottom end of the inner cylinder joint 4 is connected with a top end of an inner cylinder 8 by threads.

A bottom end of the double-way joint 3 is connected with a top end of an outer cylinder 7 through an external thread joint, and a bottom end of the outer cylinder 7 is connected with a top end of an outer cylinder joint 9 through an internal thread structure, wherein an inner cylinder 8 is coaxially provided inside the outer cylinder 7, and a bottom end of the inner cylinder 8 is suspended above the outer cylinder joint 9.

A bottom end of the outer tube 6 is sleeved on a top periphery of a middle joint 11 and welded to the top of the middle joint 11.

A passage is provided in a center position of the middle joint 11, and a top of the passage is in threaded connection with a bottom end of an upper cylinder 10 through an internal thread joint, and a top end of the upper cylinder 10 is connected with a bottom end of a center passage of the outer cylinder joint 9 through threads.

The middle joint 11 is provided with a second liquid inlet hole 111 disposed along a radial direction of the middle joint 11 itself, and the second liquid inlet hole 111 further communicates with a center passage of the middle joint 11.

A sixth liquid inlet hole 101 is provided in a wall of the upper cylinder 10 along a radial direction of the upper cylinder 10, and the sixth liquid inlet hole 101 communicates with an inner space of the upper cylinder 10.

A bottom end of the middle joint 11 is in threaded connection with a top end of a lower cylinder 12 through an internal thread joint, a bottom end of the lower cylinder 12 is in threaded connection with a top end of a lower joint 13 through an internal thread structure, a bottom end of the lower joint 13 is in threaded connection with a top end of a bottom cylinder 15 through an internal thread structure, and a bottom end of the bottom cylinder 15 is suspended.

An inner diameter of the lower cylinder 12 is larger than an inner diameter of the upper cylinder 10.

An outer periphery of the bottom end of the lower joint 13 is connected with a top end of a lower joint outer tube 16 through an oil pipe coupling 14, and a bottom end of the lower joint outer tube 16 is screwed with a lower pump cylinder joint 17 through an external thread structure.

In the present embodiment, a first passage is formed between the shell 5 and the outer tube 6, and the first passage communicates with a connecting passage formed in the lower pump cylinder joint 17, and further communicates with an inner space of the lower pump cylinder joint 17.

The second liquid inlet hole 111 communicates an inner space of the middle joint 11 with the first passage.

A second passage is formed between the outer tube 6, the outer cylinder 7 and the upper cylinder 10, and the sixth liquid inlet hole 101 communicates an inner space of the upper cylinder 10 with the second passage.

A third passage is formed between the inner cylinder 8 and the outer cylinder 7. Since the bottom end of the inner cylinder 8 is suspended above the outer cylinder joint 9, the third passage is communicated with an inner space of the inner cylinder 8, and a bottom end of the oil inlets 31 in the double-way joint 3 is communicated with the third passage. Power fluid delivered by the ground pressure equipment can enter the third passage through the center pipe, the center pipe joint 1 and the oil inlet 31.

Figure 9:
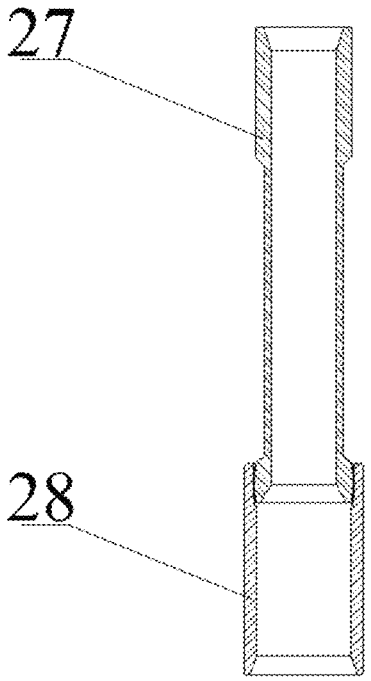
FIG. 9 is a schematic structural diagram of a valve core assembly in the Embodiment 1 of the present invention.

As shown in FIG. 9, the valve core assembly is provided in a space formed by the upper cylinder 10, the middle joint 11 and the lower cylinder 12, and comprises an upper valve core 27 and a lower valve core 28 connected to a bottom of the upper valve core. A first annular boss is provided on a top of the upper valve core 27, and the first annular boss is positioned inside the upper cylinder 10 and is in clearance fit with the upper cylinder 10.

A second annular boss is provided at a bottom of the upper valve core 27, and the second annular boss is connected with a top end of the lower valve core 28 through an external thread structure. The lower valve core 28 is positioned inside the lower cylinder 12 and is in clearance fit with the lower cylinder 12.

A diameter of a passage at the center of the middle joint 11 is larger than an outer diameter of the upper valve core 27, and the upper valve core 27 extends into the lower cylinder 12 through the passage at the center of the middle joint 11.

A fourth passage is formed between an outer surface between the first annular boss and the second annular boss of the upper valve core 27 and inner surfaces of the upper cylinder 10, the middle joint 11, and the lower cylinder 12.

A movement of the valve core assembly along a axis of the entire hydraulic directional control valve can drive a position of the fourth passage to change.

In the present embodiment, a sum of cross-sectional areas of the second annular boss and a bottom end of the lower valve core 28 is larger than a cross-sectional area of the first annular boss.

Figure 10:
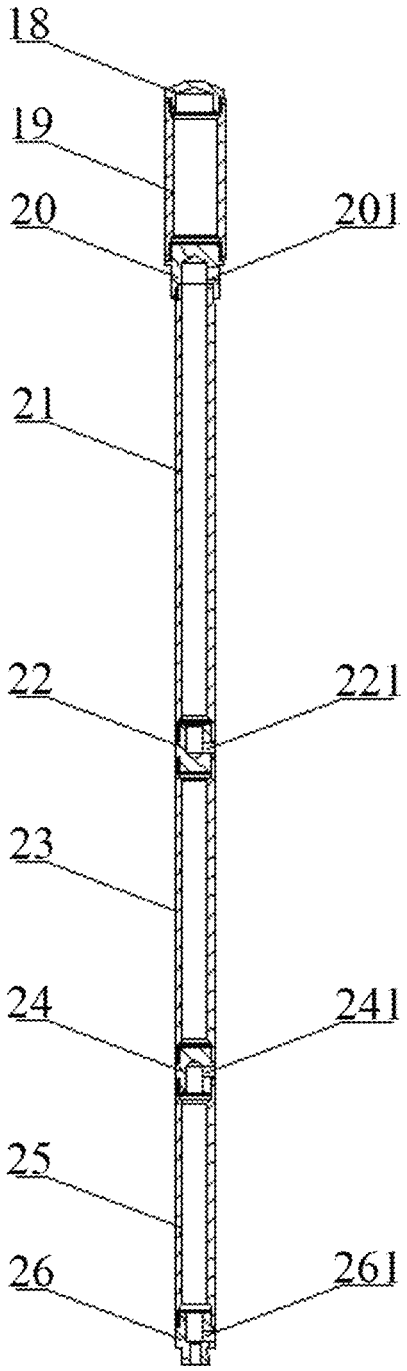
FIG. 10 is a schematic structural diagram of a plunger assembly in the Embodiment 1 of the present invention.

As shown in FIG. 10, the plunger assembly comprises a first plunger part and a second plunger part, wherein the first plunger part is positioned in the inner cylinder and is in clearance fit with the inner cylinder, and the second plunger part sequentially penetrates through the outer cylinder joint, the valve core assembly, the lower cylinder, the bottom cylinder, and the lower pump cylinder joint. A cross-sectional area of the first plunger part is larger than a cross-sectional area of the second plunger part, and the difference in cross-sectional area between the first plunger part and the second plunger part is smaller than the cross-sectional area of the first plunger part.

The first plunger part 19 is of a hollow structure, and an upper plug 18 is fixed at a top end of the first plunger part 19.

The second plunger part is in clearance fit with the upper valve core, and comprises a first section 21, a second section 23 and a third section 25 provided in sequence, wherein the first section 21 is connected with a bottom end of the first plunger part 19 through a first joint 20; a third liquid inlet hole 201 is provided in the first joint 20; the third liquid inlet hole 201 is an L-shaped hole and is communicated with an inner space of the first section 21, and further communicates a top end of the inner space of the first section 21 with an outer space of the second plunger part.

The first section 21 is connected to the second section 23 by a second joint 22, and an L-shaped fourth liquid inlet hole 221 is provided in the second joint 22. The fourth liquid inlet hole 221 extends to the inner space of the first section 21, and communicates a top end of the inner space of the first section 21 with the outer space of the second plunger part.

A bottom end of the second section 23 is connected to a top end of the third section 25 through a third joint 24, and an L-shaped fifth liquid inlet hole 241 is provided in the third joint 24. The fifth liquid inlet hole 241 communicates with an inner space of the third section 25, and further communicates a top end of the inner space of the third section 25 with the outer space of the second plunger part.

A fourth joint 26 is provided at a bottom end of the third section 25, a seventh liquid inlet hole 261 is provided in the fourth joint 26 and communicates with a through hole at a center of the fourth joint 26, the through hole penetrates through upper and lower end surfaces of the fourth joint, and the fourth joint is used for connecting with a plunger of an oil-well pump.

In the present embodiment, the first plunger part is disposed inside the inner cylinder 8 such that the third liquid inlet hole 201 communicates with the third passage.

In the present embodiment, a space above the first plunger part is an upper valve chamber, a space below the upper valve core 27 and between an inner surface of the lower valve core 28 and the second plunger part is a lower valve chamber, and the lower valve chamber is located in the lower cylinder 12.

The fourth inlet hole 221 and the fifth inlet hole 241 are matched with the lower valve chamber, and can realize a switching of On/Off states along with a movement of the plunger assembly.

The second plunger assembly matches with an internal passage of the lower joint 13 and is in clearance fit with the lower joint 13. And, an outer diameter of the second plunger part is smaller than an inner diameter of the outer cylinder joint 9, thereby forming a space for power fluid to flow.

Example 2

The present embodiment provides a working method of the downhole hydraulic directional control valve used by hydraulic drive pumps described in the Example 1: connecting an oil-pipe upper joint to an oil pipe, connecting a top end of the outer pipe to the center pipe, connecting the lower pump cylinder joint to a pump cylinder of the oil-well pump, and connecting the bottom end of the plunger assembly to the plunger of the oil-well pump.

Figure 1:
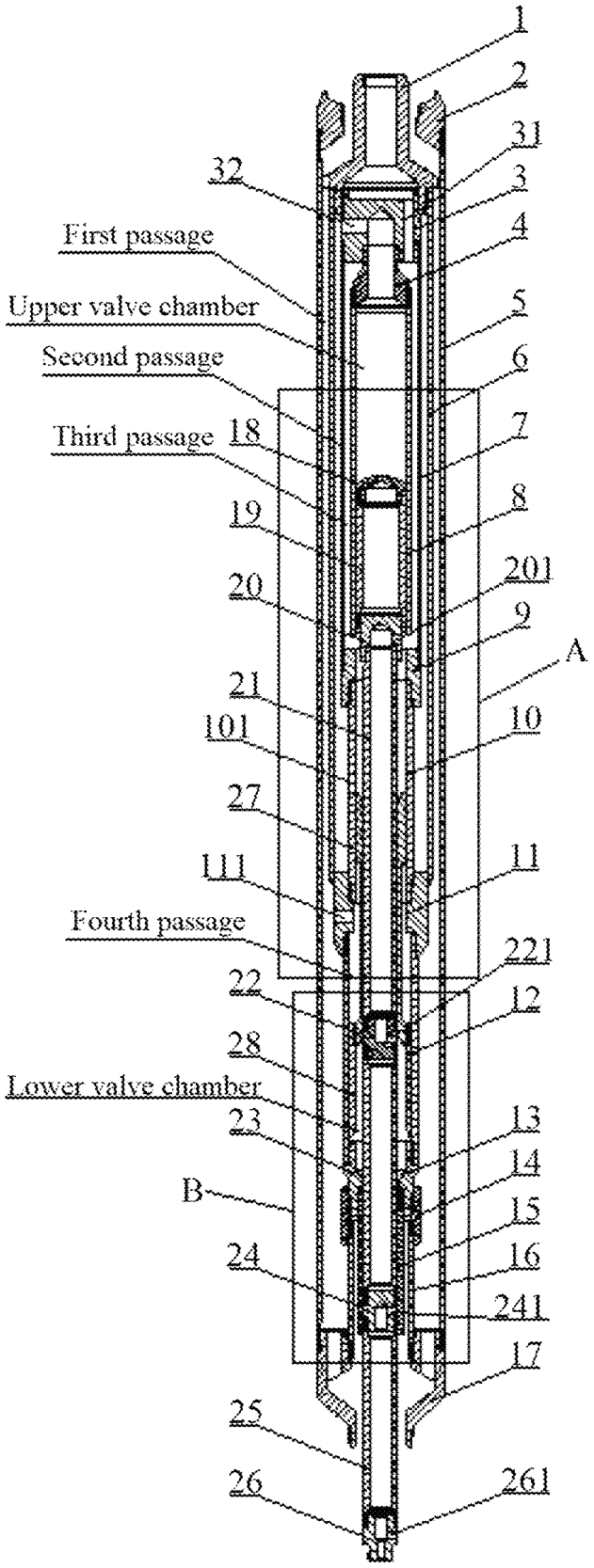
FIG. 1 is a first schematic diagram of an overall structure of an Embodiment 1 of the present invention.

In the up-stroke: after a downhole operation of the hydraulic directional control valve of the present embodiment is completed, the plunger assembly is at a lower dead center, as shown in FIG. 1, the power fluid enters from the center pipe through the ground pressurizing equipment and to the third passage through the oil inlet hole 31 of the double-way joint 3. At this time, the fourth liquid inlet hole 221 communicates with the lower valve chamber, and the power fluid sequentially flows through the third passage and the third liquid inlet hole 201 into the first section 21 of the second plunger part, and then flows out to the lower valve chamber through the fourth liquid inlet hole 221. Because the sum of the cross-sectional areas of the second annular boss and the bottom end of the lower valve core is larger than the cross-sectional area of the first annular boss, the valve core assembly generates an upward force under the action of the power fluid, such that the valve core assembly moves upward until the sixth liquid inlet hole 101 communicates with the fourth passage, then the valve core assembly reaches the position shown in FIG. 2; the power fluid pressure continues to rise, and when the pressure acting on the lower cross-sectional area of the first plunger is greater than the pressure of the liquid column in the oil pipe, the plunger assembly drives the plunger of the oil-well pump to move upward, and the produced fluid pumped by the oil-well pump enters the first passage through the lower pump cylinder joint, then enters an annular chamber between the oil pipe and the center pipe, and then is discharged to the ground.

At the same time, the spent power fluid in the upper valve chamber flows into the first passage through the center hole of the double-way joint, the first fluid inlet hole 32, the second passage, the sixth fluid inlet hole 101, the fourth passage and the second fluid inlet hole 111 in sequence, and then enters the annular chamber between the oil pipe and the center pipe through the first passage and is discharged to the ground.

Figure 2:
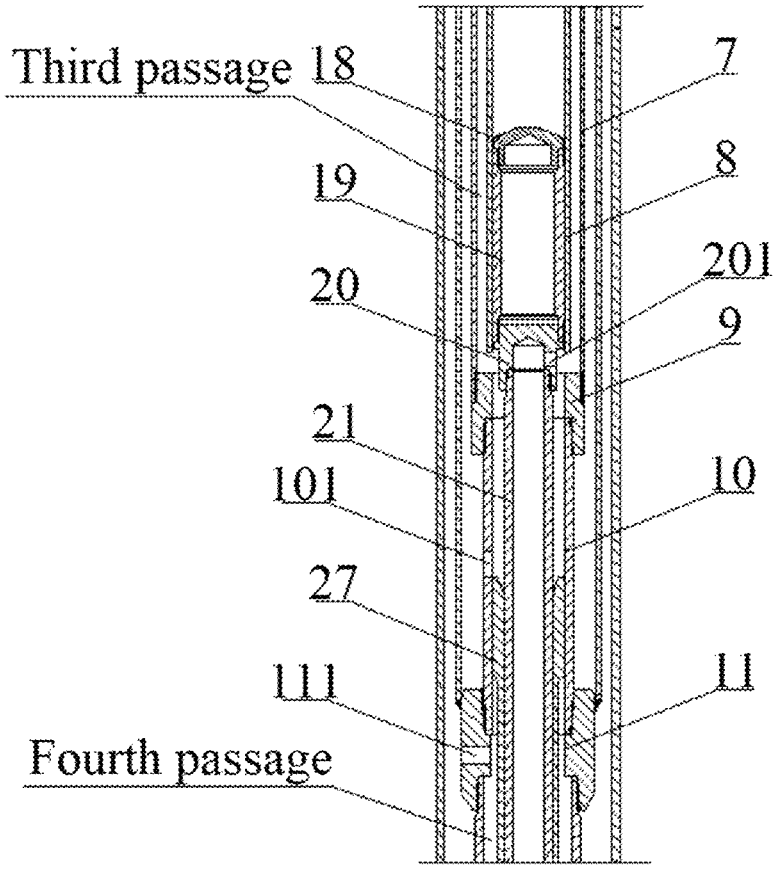
FIG. 2 is a partial enlarged view of A in FIG. 1 of the present invention.
Figure 3:
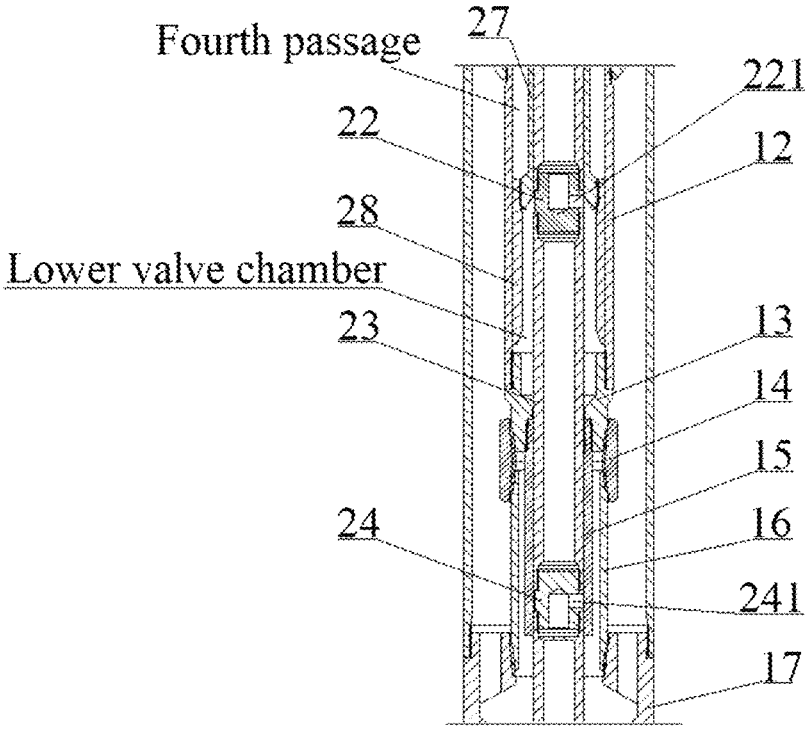
FIG. 3 is a partial enlarged view of B in FIG. 1 of the present invention.
Figure 4:
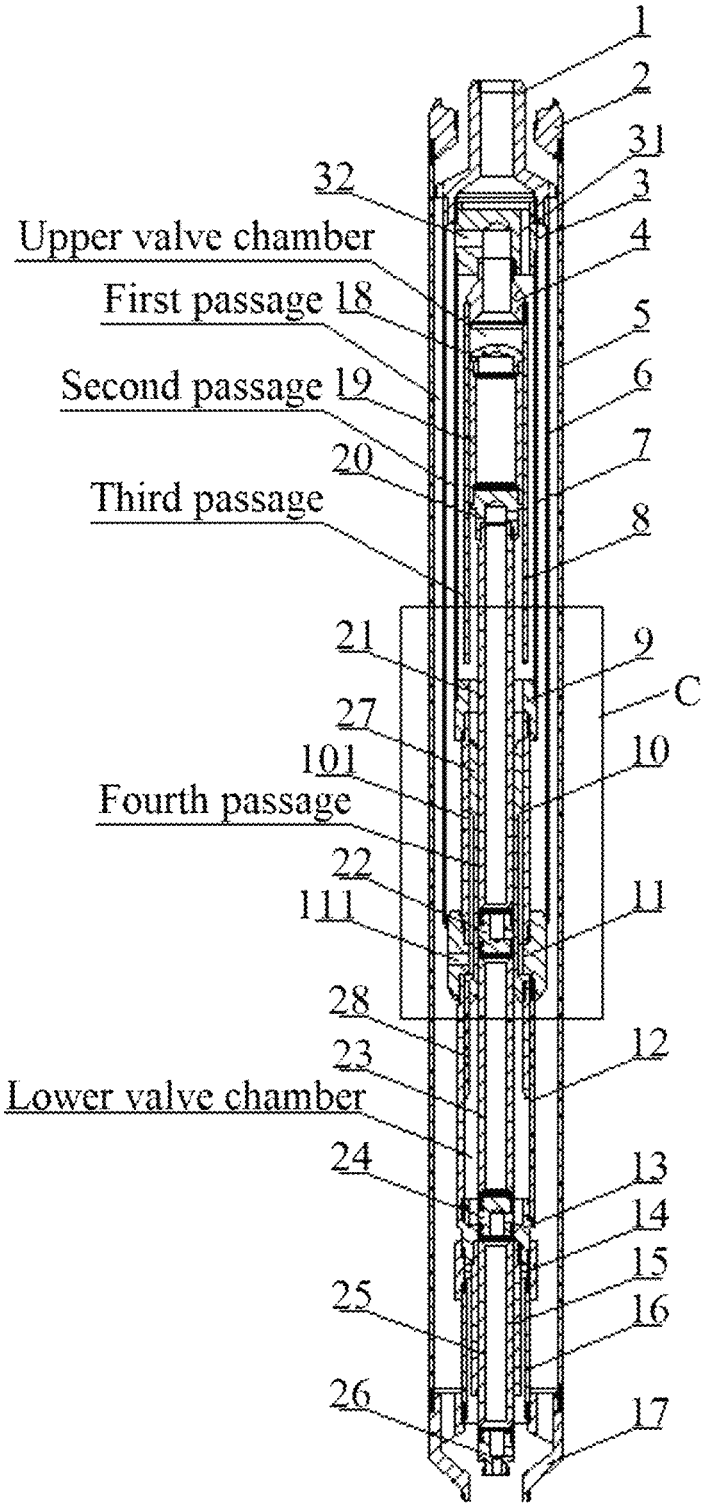
FIG. 4 is a second schematic diagram of the overall structure of the Embodiment 1 of the present invention.
Figure 5:
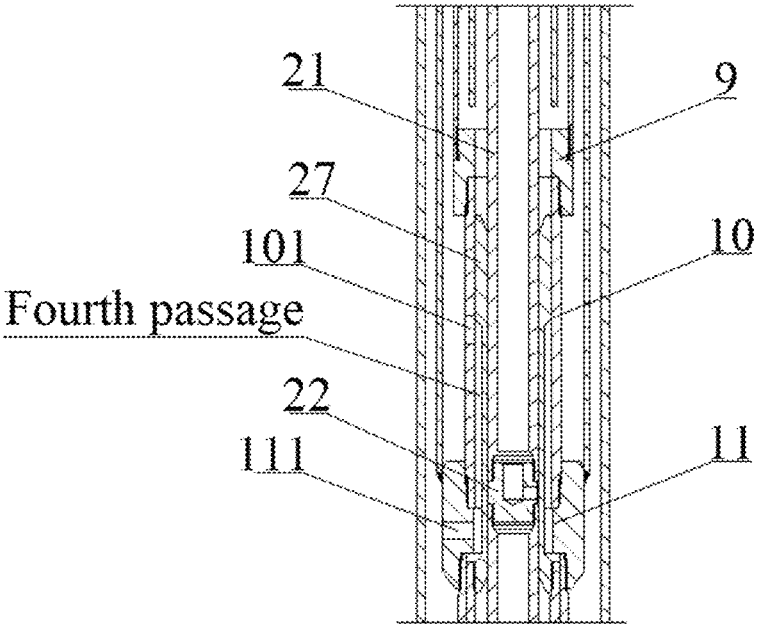
FIG. 5 is a partial enlarged view of C in FIG. 4 of the present invention.

In the down-stroke: when the plunger assembly travels up to the upper dead center, as shown in FIG. 2, the fifth inlet hole 241 communicates with the lower valve chamber, and the spent power fluid in the lower valve chamber enters the first passage through the fifth inlet hole 241, the inner space of the third section 25 and the seventh inlet hole 261 of the fourth joint 26 in sequence, completing the pressure relief of the lower valve chamber.

The power fluid generates a downward force on the upper end surface of the upper valve core 27, when the downward force is greater than the pressure of the liquid column in the oil pipe, the valve core assembly moves downward until the sixth liquid inlet hole 101 communicates with the third passage, and the valve core assembly reaches the position shown in FIG. 1, a part of the power fluid enters the upper valve chamber through the third passage, the sixth liquid inlet hole 101, the second passage, the first liquid inlet hole 32 and the center hole; because the cross-sectional area of the first plunger part is larger than the difference between the cross-sectional areas of the first plunger part and the second plunger part, a downward force is generated under the action of the power fluid, and the plunger assembly drives the plunger of the oil-well pump to move downward, and the produced fluid pumped by the oil-well pump enters the first passage; and, when the plunger assembly moves down to the lower dead center, the actions in the up-stroke are repeated, and a reciprocating linear motion of the automatic directional change is completed.

During the whole process, it only needs to introduce the power fluid into the double-way joint all the time, the ground pressure equipment does not need to perform directional change through repeated pressure relief and pressure increase, and the directional change process is automatically completed through the downhole hydraulic directional control valve, the produced fluid and the spent power fluid are always discharged through the first passage, such that the directional change time is greatly shortened, the pressure loss is greatly reduced, the efficiency is obviously improved, and the reliability of the equipment is ensured.

Although the specific embodiments of the present invention are described above in combination with the accompanying drawings, it is not a limitation on the protection scope of the present invention. Those skilled in the art should understand that on the basis of the technical solution of the present invention, various modifications or deformations that can be made by those skilled in the art without creative labor are still within the protection scope of the present invention.

The invention claimed is:

1. A downhole hydraulic directional control valve used by a hydraulic drive pump, comprising:

a valve body assembly, comprising a shell, an outer tube is provided in the shell, a first passage is formed between the outer tube and the shell, the outer tube is sleeved at a top end of a middle joint sleeved at a bottom end of an upper cylinder, a top end of the upper cylinder is connected with an outer cylinder, a second passage being formed between the outer cylinder, the upper cylinder, and the outer tube, a third passage is formed between the outer cylinder and an inner cylinder provided in the outer cylinder, top ends of the outer cylinder and the inner cylinder are connected with a double-way joint, a central hole of the double-way joint is communicated with the second passage and is further provided with an oil inlet hole communicated with the third passage, an inner space of the upper cylinder is communicated with the second passage, and an inner space of the middle joint is communicated with the first passage;

a valve core assembly, comprising an upper valve core and a lower valve core positioned at a bottom end of the upper valve core, wherein the upper valve core is positioned in the upper cylinder and a fourth passage is formed between the upper valve core and the upper cylinder, and the lower valve core is positioned in a lower cylinder positioned at a bottom end of the middle joint; wherein, a top end of the upper valve core is provided with a first annular boss, the first annular boss is in clearance fit with an inner surface of the upper cylinder, a bottom end of the upper valve core is provided with a second annular boss, a top end of the lower valve core is sleeved and fixed on a periphery of the second annular boss and is in fit with the lower cylinder, a fourth passage is formed between the first annular boss and the second annular boss, and a sum of cross-sectional areas of the second annular boss and a bottom end of the lower valve core is larger than across-sectional area of the first annular boss;

and, a plunger assembly, being configured to pass through the valve core assembly and comprising a first plunger part positioned in the inner cylinder and a second plunger part provided at a bottom end of the first plunger part, a top end of an inner space of the second plunger part is communicated with the third passage, and a liquid inlet hole, matched with an inner valve chamber of the lower cylinder, is further provide on the second plunger part;

wherein, the second plunger part comprises a first section, a second section and a third section provided in sequence, wherein the first section is connected with the first plunger part through a first joint, a third liquid inlet hole communicated with the first section is provided on the first joint, the first section further is communicated with the second section through a second joint, a fourth liquid inlet hole communicated with the first section is provided on the second section, the second section is connected with the third section through a third joint, and a fifth liquid inlet hole communicated with the third section is provided on the third joint;

the first plunger part is disposed inside the inner cylinder, such that the third liquid inlet hole is communicated with the third passage; and a space above the first plunger part is an upper valve chamber, a space below the upper valve core and between an inner surface of the lower valve core and the second plunger part is a lower valve chamber, and the lower valve chamber is located in the lower cylinder, the fourth inlet hole and the fifth inlet hole are matched with the lower valve chamber, and can realize a switching of On/Off states along with a movement of the plunger assembly.

2. The downhole hydraulic directional control valve used by the hydraulic drive pump according to claim 1, wherein a top end of the outer tube is connected with a center pipe joint.

3. The downhole hydraulic directional control valve used by the hydraulic drive pump according to claim 1, wherein a first liquid inlet hole is provided on the double-way joint to communicate the center hole of the double-way joint with the second passage.

4. The downhole hydraulic directional control valve used by the hydraulic drive pump according to claim 1, wherein a second liquid inlet hole is provided on the middle joint to communicate the inner space of the middle joint with the first passage.

5. The downhole hydraulic directional control valve used by the hydraulic drive pump according to claim 1, wherein a top end of the shell is connected with an oil pipe upper joint, and a bottom end of the shell is connected with a pump cylinder lower joint.

6. The downhole hydraulic directional control valve used by the hydraulic drive pump according to claim 1, wherein a bottom end of the lower cylinder is connected with a bottom cylinder through a lower joint, and the bottom cylinder is positioned at a periphery of the second plunger part, a lower joint outer tube is provided at a periphery of the bottom cylinder, and the lower joint outer tube is connected with the lower joint through an oil pipe coupling.

7. The downhole hydraulic directional control valve used by the hydraulic drive pump according to claim 1, wherein a difference in cross-sectional areas between the first plunger part and the second plunger part is smaller than a cross-sectional area of the first plunger part.

8. A working method of the downhole hydraulic directional control valve used by the hydraulic drive pump according to claim 1, comprising:

an up-stroke: when the plunger assembly moves to a lower dead center, a power fluid is introduced into the inner valve chamber of the lower cylinder through the oil inlet hole, the third passage, the inner space of the second plunger part and the liquid inlet hole thereof, the valve core assembly is moved upward under an action of the power fluid until the fourth passage is communicated with the second passage, a plunger of an oil-well pump is drove, by the plunger assembly, to move upward under a working condition that a pressure of the power fluid continues to rise, and the produced fluid is discharged to the ground through the first passage, and a spent power fluid in a space above the plunger assembly is discharged, through the guide of the center hole of the double-way joint, the second passage, the fourth passage, and the middle joint, to the ground through the first passage;

and a down-stroke: when the plunger assembly moves to a upper dead center, the power fluid is guided, through the double-way joint, into the first passage, the valve core assembly is descended to the third passage under the action of the power fluid to be communicated with the second passage through the upper cylinder, the power fluid is guided, by the third passage and the second passage, into the valve chamber above the plunger assembly through the center hole of the double-way joint to drive the plunger assembly to descend, which can drive the plunger of the oil-well pump to move downward, and the produced fluid is discharged to the ground through the first passage.

* * * * *